United States Patent [19]

Chang et al.

[11] Patent Number: 4,798,125

[45] Date of Patent: Jan. 17, 1989

[54] PNEUMATIC TYPE OF HYDRAULIC STRUCTURE

[76] Inventors: Fung M. Chang, No. 11, Lane 58, Tz Li Rd., Chung Ho; Chien C. Hsu, No. 18, Lane 89, Tung Hsin St. Nanking District, Taipei; Wen C. Chen, No. 4, Alley 29, Lane 147, Chung Hsiao Rd., Lu Chou Village, all of Taiwan

[21] Appl. No.: 116,206

[22] Filed: Nov. 3, 1987

[51] Int. Cl.[4] ..... F15B 31/02

[52] U.S. Cl. ..... 91/49; 91/50; 91/229; 91/321; 91/401; 60/593

[58] Field of Search ..... 91/47, 49, 50, 321, 91/401, 229; 60/593

[56] References Cited

U.S. PATENT DOCUMENTS

| | | | |
|---|---|---|---|
| 2,649,078 | 8/1953 | Kelly | 91/229 X |
| 2,839,032 | 6/1958 | Reynolds | 91/401 |
| 3,005,444 | 10/1961 | Steibel | 60/593 X |
| 3,230,839 | 1/1966 | DeGaston | 91/50 |
| 3,307,639 | 3/1967 | Wilder et al. | 91/50 X |
| 3,960,058 | 6/1976 | Berkelius | 91/50 X |

*Primary Examiner*—Edward K. Look
*Attorney, Agent, or Firm*—Morton J. Rosenberg

[57] ABSTRACT

This invention pertains to a pneumatic mode under which the structure of a hydraulic system is driven, particularly denoting the pneumatic mode under which a mini air compressor is being used as a means to elevate a hydraulic jack.

This invention makes use of a working lever and a working body attached to the hydraulic mechanism which is compactly closed inside a body to drive the hydraulic lever of the hydraulic mechanism which is compactly closed at the other end of the body to conduct a continuous backward/forward movement which will press against and elevate the hydraulic jack. Such a movement is similar to a continuous backward/forward movement conducted by a piston in a cylinder body. However, the entire structure and effected of this invention is found much better because of its easy fabrication and its function of elevating the hydraulic jack by means of a pneumatic mode, which saves both time and strength and thus meet the requirement of a simple and automatic operation.

1 Claim, 7 Drawing Sheets

PNEUMATIC TYPE OF HYDRAULIC STRUCTURE

BACKGROUND OF THE INVENTION

This invention pertains to the application of a pneumatic mode to drive a hydraulic system, particularly denoting a pneumatic mode under which a mini air compressor is being applied to drive a hydraulic system, so as to elevate a jack.

Presently, most of the conventional jacks are categorized as either of a mechanical or a hydraulic type. They are operated manually or by foot to achieve their objective of elevation. Such modes of operation are time and strength consuming, which cause great inconvenience to their operation. As air compressors are commonly available under the industrial progress of today, it seems much simpler to elevate a hydraulic jack by the utilization of air pressure.

The inventor, based on the aforementioned concept, started to dedicate himself in the design and development of such a structure which will be able to elevate a hydraulic jack by the utilization of air pressure, and he managed to successfully present this invention as the embodiment of this concept, wherein the mini type of air compressor which is attached to an automobile or a larger capacity of air compressor which is utilized in a plant is found connected by a pipeline and a rapid joint to this invention as the source of air pressure to drive the hydraulic jack.

BRIEF DESCRIPTION OF THE DRAWING

The following drawings and illustrations are provided for the better understanding of the spirit, features and objectives of this invention.

DETAILED DESCRIPTION OF PREFERRED EMBODIMENT

Figure 1:
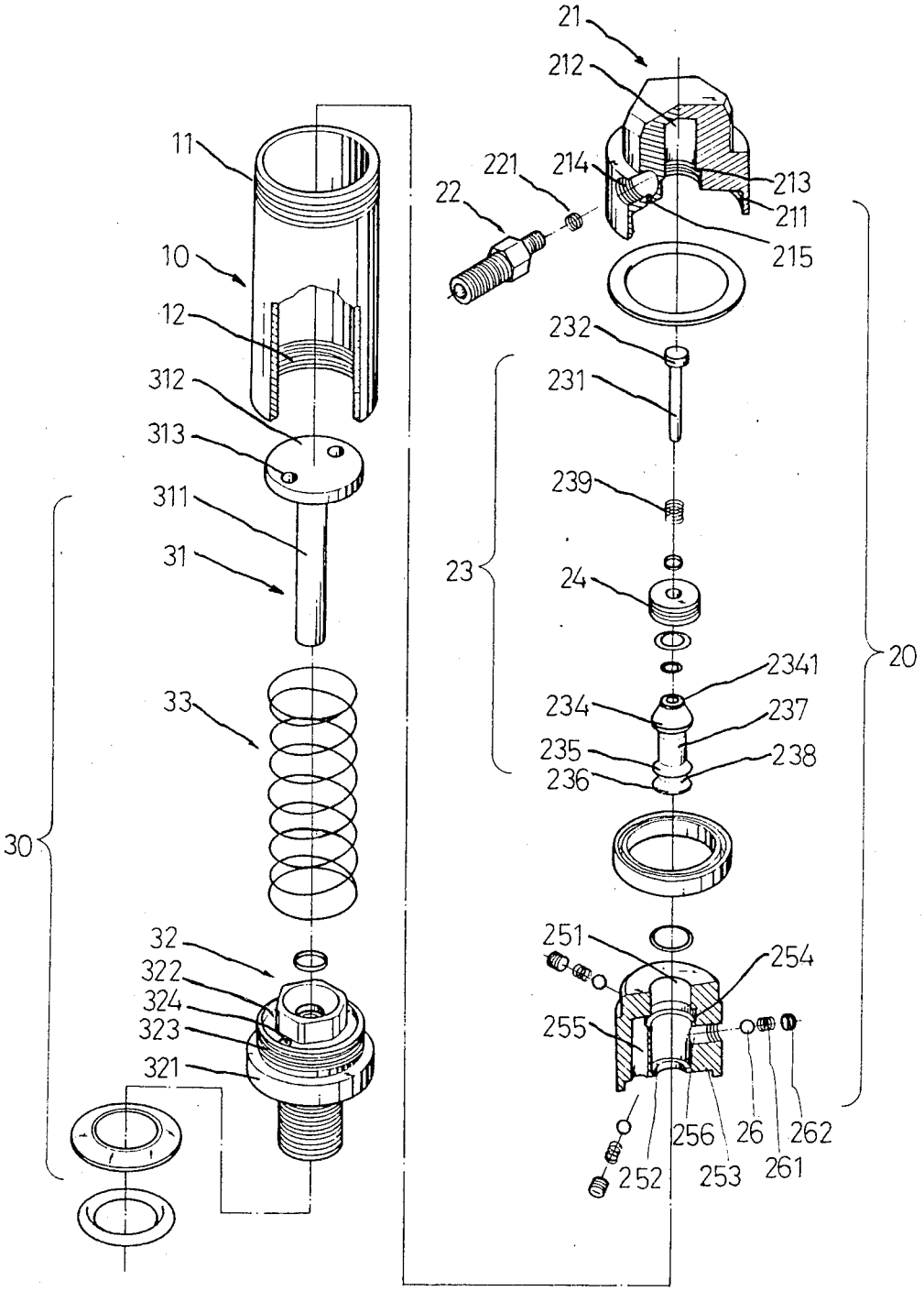
FIG. 1 is a drawing illustrating the solid segmentation cross section of this invention.

As shown as FIG. 1, this invention comprises of a pneumatic part 20 and a hydraulic part 30 which are separately attached to each of the two ends of the body, in which the body 10 is a hollow column body having threads 11, 12 attached at each of the two ends for joining purpose; and the pressure part mainly comprises of a lid body 21 which is having a joining thread 211 set at the opening at one end to lock with thread 11 of the main body 10 and a closing end at the other end, with a chamber 212 set at its interior. There is position thread 213 set at the opening of the movable chamber 212. An air inlet screw hole 214 is set at the lateral side of the lid body 21 and an air passage hole 215 set at the lower position of the extreme closely end of the aforementioned air inlet screw hole 214. There is an air inlet joint 22 which can be locked into the air inlet screw hole 214. Prior to its locking, a filtering net 221 has first to be placed in to prevent the air inlet passage hole 215 from being polluted or blocked. A working lever 23 comprises of a front end part 231 which is having a rather small outer diameter and a rear end part 233 which is having a rather big outer diameter. There is a front convex edge 232 set at the extreme front end of the front end part 231, while a front convex edge 234 is set at the middle of the front, rear position and the position close to the rear of the rear end part 233. Among the front convex edge 234, rear convex 236, middle convex edge 235, an air inlet engagement part 237 is formed, while an air exhaust engagement part 238 is formed between the middle convex edge 235 and the rear convex edge 236 between the front convex part 232 of the front end part 231 and the front edge part 234 of the rear end part 233, a spring 239 and a position screw 24 which is located underneath spring 239 are inserted to enable the front edge part 231 of the working lever 23 to move at the front and rear position of the position screw 4. That is to say, when the position screw 24 is being locked on the position thread 213 of the lid body 21, the front end part 231 of the woring lever 23 is able to function inside the working chamber 212. A working body 25 is having a hollow chamber 251 inside, which allows the working lever 23 to match compactly with its functioning inside the chamber, there is an interior convex edge 252 located at the extreme end of the working chamber 251 which serves as a stopping end for the working lever 23. There is a working face 253 located below the interior convex edge 252. An air exhausting ring groove 254 is set at an appropriate position inside the chamber 251, with several air exhausting holes 255 which connected ring groove 254 with the working face 253. Moreover, there are certain steel ball holes 256 located at the lateral side of the working body 25. Certain steel balls placed inside the holes 256, above which there is small spring 261 and a small screw 263. The steel balls 26 can be squeezed into the air inlet engagement part 237 or into the air exhausting engagement part 238. The hydraulic part 30 comprises mainly of a hydraulic lever 31 which composed of a levr 311 and the pressing plate 312 located at the front edge of the lever 311. There are passage holes 313 set on the pressing plate 312 for air exhaustion. Pressing plate 312 is opposing to the working face 253 of the working body 25 of the air pressure part 20. A housing part 32 in the form of a hollow body is available for the insertion of the lever part 311 of the hydraulic lever 31. There is a convex edge 321 set near the middle position of the housing body 321. A spring placing part 322 is set at the front position of the convex edge 321, with a joining thread 323 which is able to interlock with the thread 12 of the main body 10 set at the outer edge. There are certain air exhaust holes 324 set underneath the convest edge 321 inside the inverted groove of the placing part 322. A working spring 33 is placed inside the lever part 311 of the hydraulic lever 31, with one end touched the lower position of the pressing plate 312 of the pressing lever 31 and another end is placed inside the inverted groove of the placing part 322 of the housing body 32. By means of the aforementioned devices as well as being coped with by certain cushion rings for buffering, air-tight and oil sealing purpose and thus completed the pneumatic type of hydraulic structure of this invention.

Figure 2A:
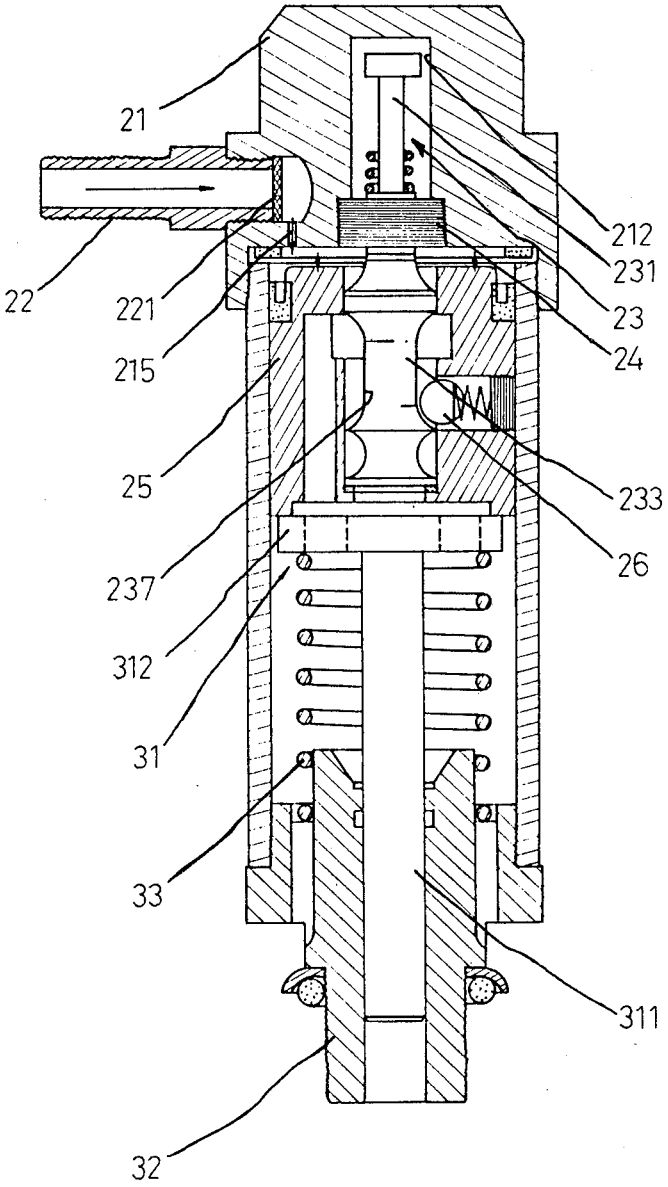
FIGS. 2A, 2B, 2C and 2D are drawings illustrating the downward movement of the hydraulic lever of this invention.
Figure 2B:
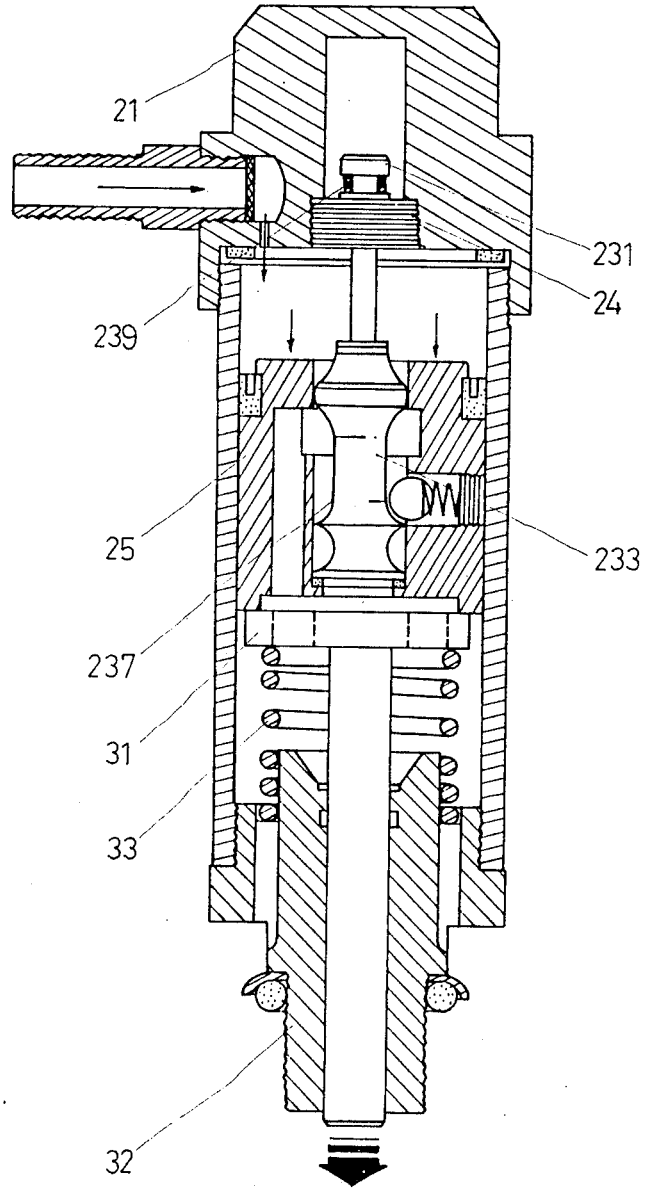
Figure 2C:
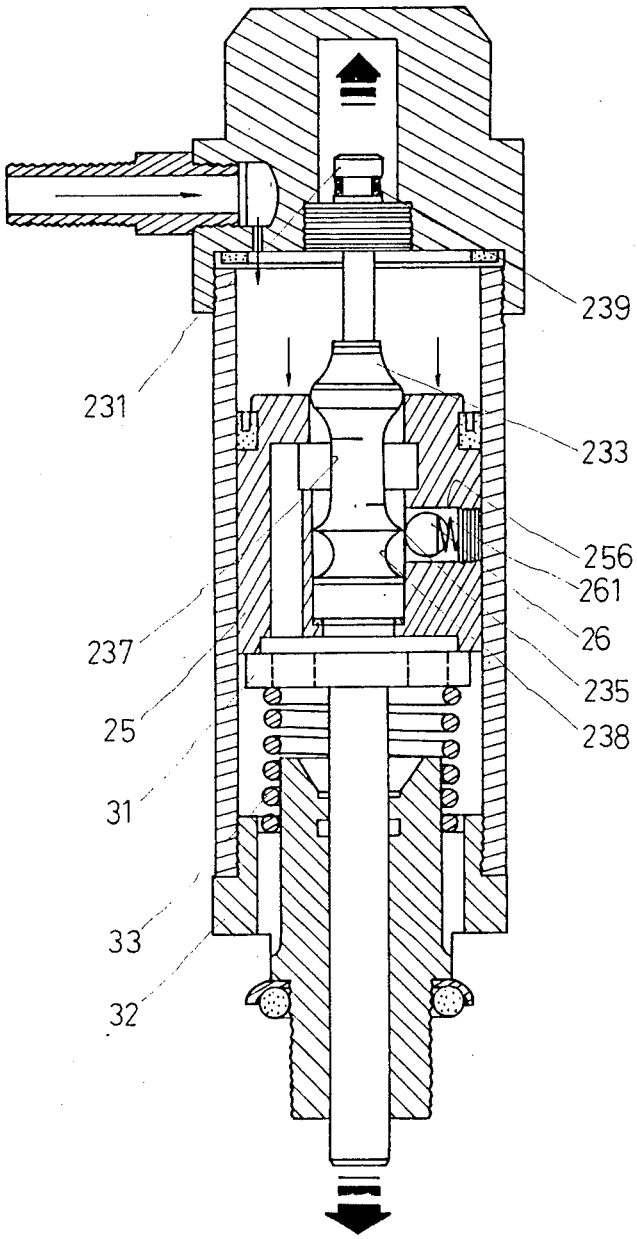
Figure 2D:
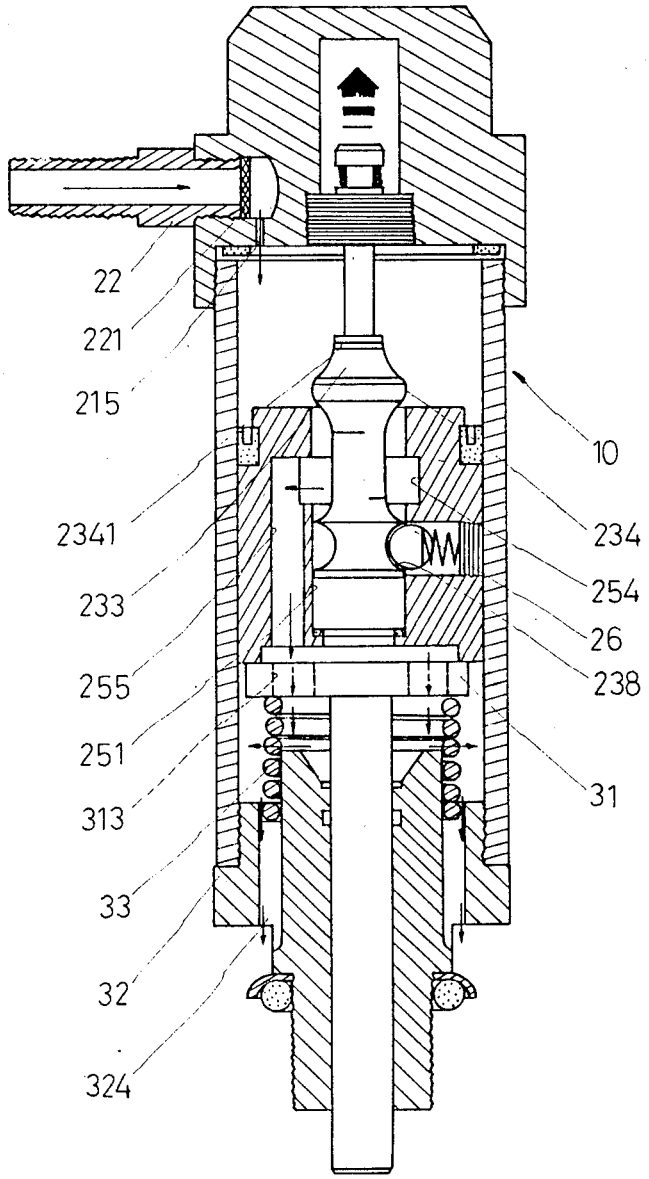
Figure 3A:
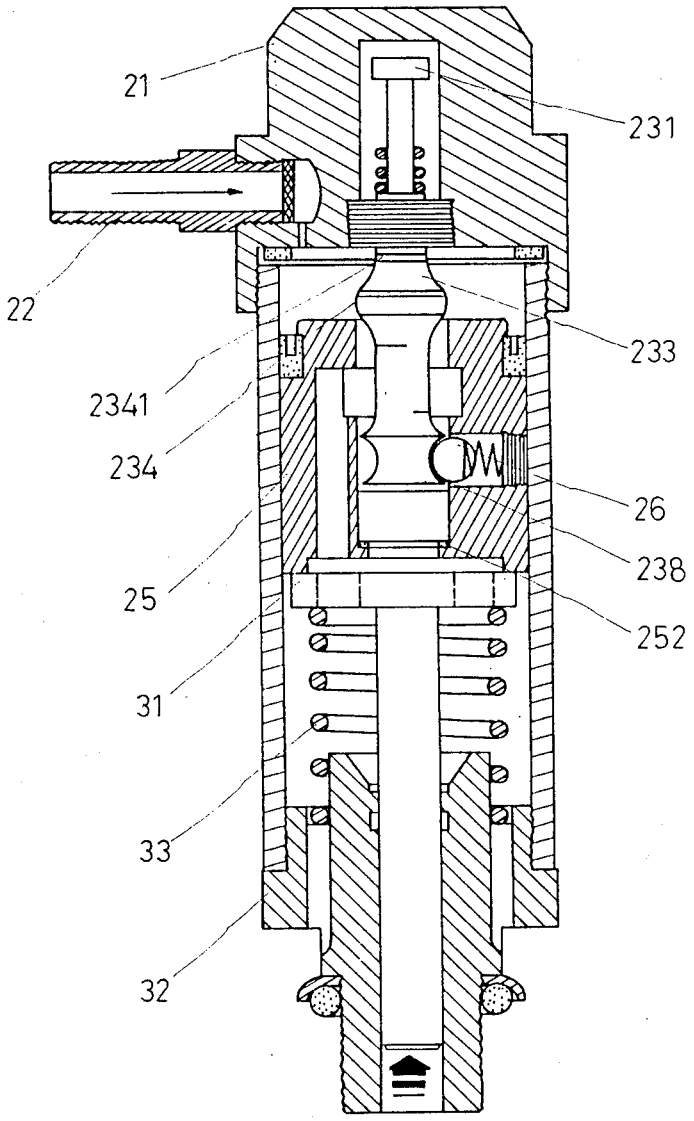
FIGS. 3A and 3B are drawings illustrating the upward movement of the hydraulic lever of this invention.
Figure 3B:
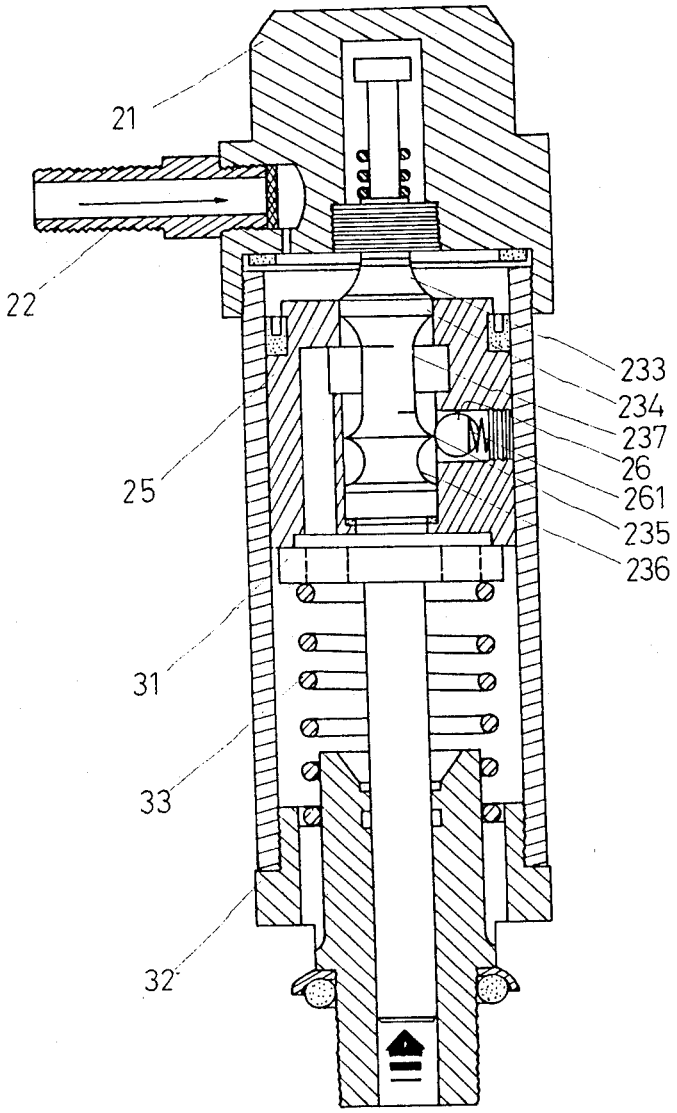

As shown by FIGS. 2A, 2B, 2C and 2D, the hydraulic lever 31 of this invention, by means of the tension of the working spring 33, caused the working body 25 and the working lever 23 to move upward until they pressed against the upper stopping point, that is to say, the front edge part 231 of the working lever 23 will be moved and located at the upper position of the chamber 212 of the lid body 21 and the steel ball will be squeezed into the air inlet engagement part 237. When the gas of the air compressor enters through the pipeline into the gas inlet joint 22 of this invention, the gas will pass through a filtering net 221 into the gas inlet passage hole 215 of the lid body 21 and then will further drive the working body 25. At this time, the working body 25 and the working lever 23 will both be moved downward, and the working body 25 will move the hydraulic lever which is located at its lower position downward. Therefore, the working spring 331 will gradually be shrink under the pressure of the pressing plate 312, and the working lever 23 will move downward until it reaches the lower stopping point, which will then stop moving downward because of the restraint of the position screw 24 (as shown by FIG. 2B). However, the working lever 23 which matches compactly with the working body 25 will continue to press downward. Therefore, the steel balls which are being squeezed by and the air inlet engagement part 237 and the working body 23 will gradually move toward the air exhaust engagement part 238. The middle convex edge 235 of the working lever 23 will gradually push the steel ball 26 into the placing hole 256 of the working body 25 (as shown by FIG. 2C). When the steel balls 26 cross the middle convex edge 235, they will be sprung back by the small spring 261 and squeezed into the air exhaust engagement part 238. At this time, the air-tight cushion ring located on the front convex edge 234 of the working lever is just on its way leaving the chamber 251, so as to cause the gas to flow into the chamber 251, and further pass through the air exhaust ring groove 254 to flow into the air exhaust passage hole 255. Then, the gas will further pass through the passage hole 313 of the hydraulic lever 31 to the release hole 324 of the housing body 32 to be exhausted out of the air-tight body 10 (as shown by FIG. 2D). Moreover, a backward/forward force provided by a spring 239 which is being pressed upon by the front convex edge 232 of the front edge part 231 of the working lever 23 will accelerate the working lever 23 to move upward and will cause the steel balls 26 to be rapidly squeezed into the air exhaust engagement part 238, so as to exhaust the gas out of the main body 10.

As shown by FIGS. 2A, 2B, 2C and 2D, when the gas is flowing into the working body 25, the downward pressing force exerted by the downward working body 25 will disappear. At this time, the working spring 33, which is being pressed upon, will spring back because of the disappearance of the downward pressure and will drive the hydraulic lever 31 to move upward. The hydraulic lever 31 will then push to move upward. The hydraulic lever 31 will then push the working body 25 and the working lever 23 located inside to move upward until the base 2341 of the convex front edge 234 of the working lever 23 touched the bottom of the position screw 24 and the working lever 23 reached the upper stopping point and restrained by the position screw 24, while the working body 25 still move upward by means of the upward movement caused by the working spring 33. Therefore, the steel balls 26 will then be pressed again and shrinked into the placing hole 256 and, by crossing the middle convex edge 235 from the air exhaust engagement part 238, will then be squeezed into the air inlet engagement part 237. At the same time, the air-tight cushion ring of the front convex edge 234 of the working lever 23 will again compactly seal up the chamber 251, so that the hydraulic lever 31 will function a backward/forward movement, and thus drive the hydraulic system to elevate the jack.

Summarizing the aforementioned description, the pneumatic type of hydraulic structure of this invention is capable of elevating the hydraulic jack by means of utilizing the air pressure compressed by the air compressor which will save the trouble of manual operation by foot, so as to eliminate the waste of time and strength and to achieve an easy and convenient operation. In addition, as this invention is the result of years of research and the effect of testing given to the sample of this invention proved to be excellent and practical, the inventor is willing to provide said samples for the evaluation of experts, if it is so required.

We claim:

1. A pneumatically actuated hydraulic system comprising:

a hollow elongated body column member having threads formed on opposing ends thereof;

pneumatic means for actuating said hydraulic system, said pneumatic means including a lid body member having a first open end where said threads are engaged and a second closed end, said second closed end having a chamber formed therein, a position screw positionally located within an opening of said chamber, an inlet screw hole formed through a sidewall of said chamber having an air inlet passage hole positioned at a lower end of said air inlet screw hole;

a working lever member including a front end portion having a predetermined diameter and a rear end portion having an outer diameter greater than said front end portion diameter, said front end portion defining a convex edge located at one end of said front end portion and further including a front convex edge, a rear convex edge and a middle convex edge located respectively at a front, rear and central position near a rear section of said rear end portion, and including an air inlet engagement member located between said front convex edge and said middle convex edge of said rear edge, an air exhaust engagement member located between said middle convex edge and said rear convex edge, said position screw member positioned between said front convex edge of said front end portion of said working lever and said front convex edge of said rear end portion enabling said front end portion of said working lever to reciprocally move on said position screw, said position screw being secured onto said lid body member, a spring member is housed on a frontal end of said position screw of said front end portion;

a working body having a hollow chamber within which is located said working lever, said hollow chamber having an interior convex edge located at an extreme end of said hollow chamber to serve as a termination point for said working lever, an air exhaust ring groove located within said hollow chamber having a plurality of air exhaust holes fluidly connected with said ring groove, and placement holes formed within a lateral sidewall of said working body for placement of steel ball members;

an air inlet joint secured within said inlet screw hole serving as an inlet of air including a filtering net member mounted therein for filtering air;

hydraulic means for providing displacement of said hydraulic system, said hydraulic means including an hydraulic lever defining a lever composed of a lever portion and a pressing plate member located at a front end of said lever portion, passage holes located on said pressing plate member for exhausting air and contiguously interfacing with said working body of said pneumatic means;

a hollow housing body within which is contained said lever portion of said hydraulic lever, said hollow housing body having a convex edge located substantially near the central portion of said housing body, a spring location member secured at a frontal section of said convex edge and a joining thread located at an outer edge which may be threadedly secured with said threads of said main body member and further including a plurality of air release holes formed beneath said convex edge on said inverted groove of said location portion; and, a working spring member located within said lever portion of said hydraulic lever having an upper section pressed against a lower portion of said pressing plate of said hydraulic lever and an opposing end located within said housing body.

* * * * *